US008118298B2

(12) United States Patent
Ueyama et al.

(10) Patent No.: US 8,118,298 B2
(45) Date of Patent: Feb. 21, 2012

(54) SHEET FEEDING DEVICE AND IMAGE FORMING APPARATUS

(75) Inventors: Junki Ueyama, Nagoya (JP); Makoto Hattori, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 12/732,405

(22) Filed: Mar. 26, 2010

(65) Prior Publication Data

US 2010/0301543 A1 Dec. 2, 2010

(30) Foreign Application Priority Data

May 29, 2009 (JP) ..... 2009-130437

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 4,395,032 | A * | 7/1983 | Hipp, Jr. | 271/10.01 |
| 5,893,555 | A * | 4/1999 | Kawada et al. | 271/117 |
| 7,490,827 | B2 * | 2/2009 | Miki et al. | 271/117 |
| 2004/0070136 | A1 * | 4/2004 | Chung | 271/117 |
| 2004/0245704 | A1 * | 12/2004 | Hall et al. | 271/117 |
| 2004/0251592 | A1 | 12/2004 | Ruhe et al. | |
| 2008/0006987 | A1 | 1/2008 | Sonoda et al. | |
| 2009/0283960 | A1 * | 11/2009 | Bokelman et al. | 271/117 |

FOREIGN PATENT DOCUMENTS

| | | | |
|---|---|---|---|
| JP | H05-319593 | A | 12/1993 |
| JP | 07-137870 | | 5/1995 |
| JP | H07-137857 | A | 5/1995 |
| JP | H11-171354 | A | 6/1999 |
| JP | 2000-168980 | A | 6/2000 |
| JP | 2001-019185 | A | 1/2001 |
| JP | 2001-158550 | A | 6/2001 |
| JP | 2005-008416 | A | 1/2005 |
| JP | 2008-013335 | A | 1/2008 |
| JP | 2008-207941 | A | 9/2008 |
| JP | 2009-035348 | A | 2/2009 |

OTHER PUBLICATIONS

Japanese Office Action dated Jun. 28, 2011 corresponding to related case.

Japanese Office Action dated Apr. 19, 2011 corresponding to related Japanese case.

* cited by examiner

*Primary Examiner* — Kaitlin Joerger

(74) *Attorney, Agent, or Firm* — Scully, Scott, Murphy & Presser, P.C.

(57) ABSTRACT

A sheet feeding device includes a holding unit configured to hold a stack of sheets; a pickup roller, which feeds a sheet placed on top of the stack held in the holding unit when the pickup roller comes in contact with the sheet; a holder arm having a distal end to which the pickup roller is attached, wherein the holder arm has a swing center set at a position closer to the pickup roller side than the holding unit, and wherein the distal end of the holder arm extends from the swing center to the holding unit side; and a resiliently-deformable unit, which generates a swing moment to swing the holder arm to increases contact surface pressure between the sheet held in the holding unit and the pickup roller, wherein the swing moment increases as a contact angle between an extension direction of the holder arm and the sheet increases.

9 Claims, 8 Drawing Sheets

SHEET FEEDING DEVICE AND IMAGE FORMING APPARATUS

CROSS REFERENCE TO RELATED APPLICATION

The present application claims priority from Japanese Patent Application NO. 2009-130437, which was filed on May 29, 2009, the disclosure of which is incorporated herein by reference in its entirety.

BACKGROUND

The present invention relates to a sheet feeding device capable of feeding a sheet such as paper, and an image forming apparatus using the sheet feeding device.

A general sheet feeding device used in an image forming apparatus or the like includes a pickup roller which comes in contact with a paper sheet, which is positioned on an upper end, in a stack direction, of a stack of a plurality of paper sheets held in a holding unit, such as a paper supplying cassette. The pickup roller rotates to transport the paper sheet to an image forming unit.

The pickup roller is configured to apply a transport force to a paper sheet positioned on the upper end in the stack direction while rotating in contact with the paper sheet. For this reason, as the position of the paper sheet positioned on the upper end in the stack direction is separated from the pickup roller due to the decrease in the number of the paper sheets in the holding unit, the contact surface pressure between the pickup roller and the paper sheet decreases. As a result, sufficient transport force is not applied to the paper sheet causing transport performance to be deteriorated.

Consequently, in order to reliably transport a sheet such as paper, it is preferable that the contact surface pressure between the pickup roller and the paper sheet positioned on the upper end in the stack direction is constantly maintained without large fluctuations.

In this regard, for example, a related apparatus maintains a substantially constant contact surface pressure by installing a paper pressing plate, which displaces all the paper upwardly so that all the loaded paper sheets remain close to the pickup roller as the number of the loaded paper sheets decreases.

Further, for example, another related apparatus maintains the contact surface pressure to be substantially constant by displacing a stationary end (an end fixed to a body side of an apparatus) of a tension spring which generates contact surface pressure in cooperation with an operation of a solenoid, wherein the solenoid displaces the pickup roller to bring the pickup roller in contact with the paper sheet or to separate the pickup roller from the paper sheet.

SUMMARY

However, since the related apparatus requires a mechanism for upwardly displacing the paper pressing plate as the number of the paper sheets decreases, there creates a problem in that it is difficult to reduce a manufacture cost of the sheet feeding device.

In addition, the other related apparatus displaces the stationary end of the tension spring in cooperation with the operation of the solenoid, but this is unrelated to displacing the stationary end of the tension spring as the number of the loaded paper sheets decreases. Therefore, it is difficult to maintain substantially constant contact surface pressure.

An object of an exemplary embodiment of the present invention is to reduce manufacturing costs of a sheet feeding device by eliminating a mechanism for upwardly displacing a paper pressing plate and to reliably transport a paper sheet by suppressing significant fluctuations in the contact surface pressure between the paper sheet and a pickup roller.

In order to achieve the object, the exemplary embodiment of the present invention provides a sheet feeding device comprising:

a holding unit configured to hold a stack of sheets;

a pickup roller disposed in contact with a sheet placed on top of the stack held in the holding unit, the pickup roller being configured to rotated and feed the sheet from the stack;

a holder arm having a distal end to which the pickup roller is attached, wherein the holder arm has a swing center set at a position closer, in a stack direction of the stack, to the pickup roller side than the holding unit, and the distal end of the holder arm extends from the swing center to the holding unit side; and a resiliently-deformable unit, which generates a swing moment to swing the holder arm in a direction which increases contact surface pressure between the sheet held in the holding unit and the pickup roller, wherein the swing moment increases as a contact angle increases, wherein the contact angle is an angle between an extension direction of the holder arm and the sheet held in the holding unit.

DETAILED DESCRIPTION OF EXEMPLARY EMBODIMENTS

In this embodiment, a sheet feeding device is applied to a paper feeding device of an image forming apparatus, and an embodiment of the invention will be described with reference to the accompanying drawings.

1. Broad Configuration of an Image Forming Apparatus

Figure 1:
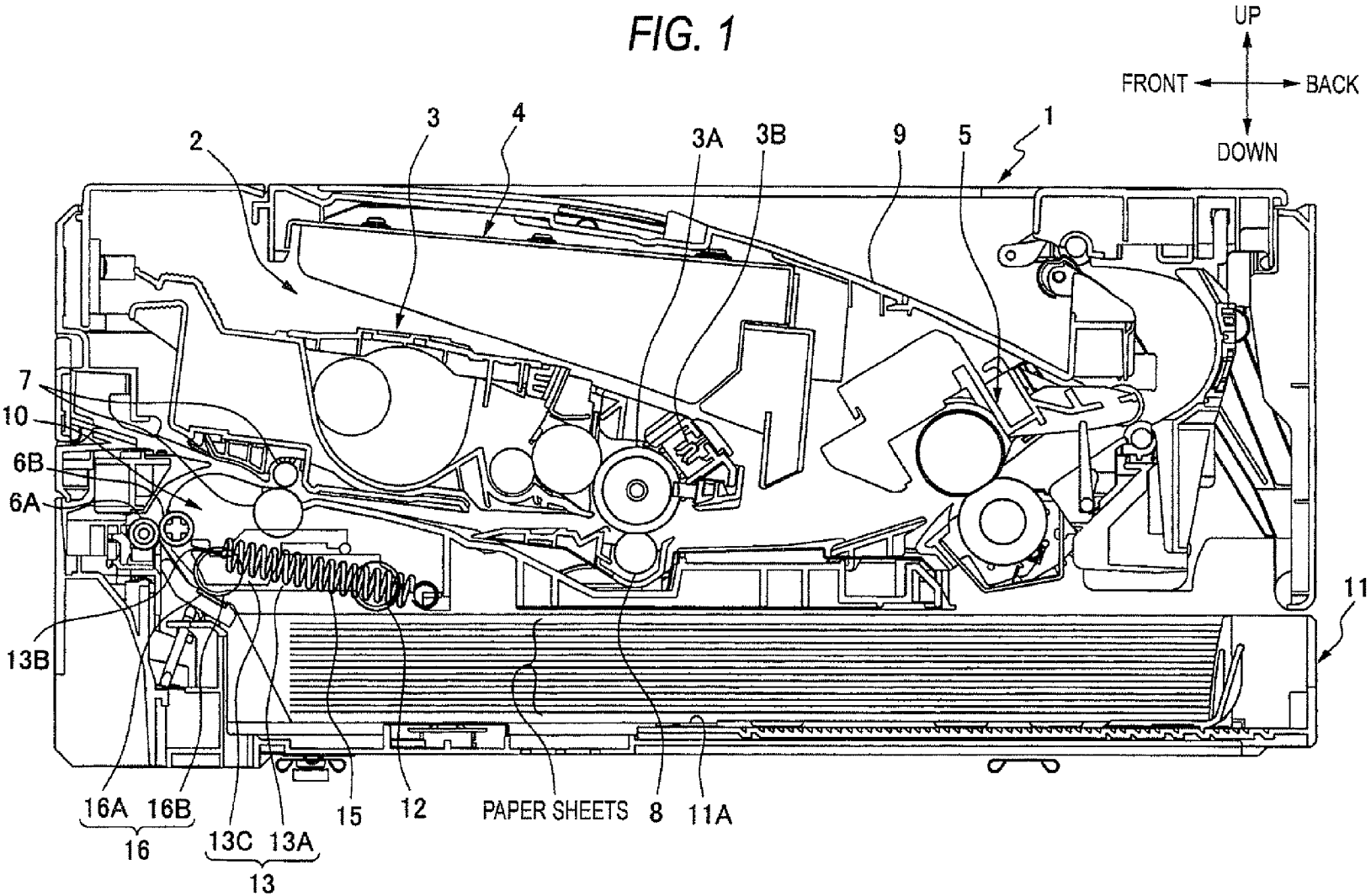
FIG. 1 is a central cross-sectional view of an image forming apparatus according to an embodiment of the invention.

An image forming apparatus 1 includes, as shown in FIG. 1, an image forming unit 2 and a paper feeding device 10. The image forming unit 2 forms (prints) an image on a paper sheet, an OHP sheet or the like (hereinafter referred to as a paper sheet), and the paper feeding device 10 feeds the paper sheet to the image forming unit 2.

The image forming unit 2 according to this embodiment is an electrophotograph-type image forming unit comprising a process cartridge 3, an exposure unit 4, and a fixing unit 5. The process cartridge 3 is equipped with a photosensitive drum 3A carrying a developer image, and a charging unit 3B to electrostatically charge the photosensitive drum 3A.

The paper sheet fed from the paper feeding device 10 towards the image forming unit 2 passes between a paper powder collecting roller 6A and a transport roller 6B where paper powder is removed from the paper sheet, and is then transported to a pair of registration rollers 7, so that a skew is corrected by the pair of registration rollers 7. Then, the paper sheet is transported to the photosensitive drum 3A. In this instance, the transport roller 6B presses the paper sheet against the paper powder collecting roller GA.

The charged photosensitive drum 3A is exposed to light by the exposure unit 4, so that an electrostatic latent image is formed on an outer circumference of the photosensitive drum. A developer (i.e., powder type toner in this embodiment) is supplied onto the photosensitive drum 3A and a developer image is carried or formed on the outer circumference of the photosensitive drum 3A.

In this instance, the transported paper sheet is interposed between the photosensitive drum 3A and a transfer roller 8, which is placed opposite to the photosensitive drum 3A, and a charge, which has a polarity opposite to the polarity of the charge applied to the developer, is applied to the transfer roller 8 so that the developer image carried on the photosensitive drum 3A is transferred onto the paper sheet.

The developer transferred on the paper sheet is then heated and fixed to the paper sheet in the fixing unit 5. A feeding direction of the paper sheet with the image formed thereon is converted in an upward direction, and the paper sheet is discharged to a paper discharge tray 9 disposed at an upper end side of the image forming apparatus 1.

2. Detailed Structure of the Paper Feeding Device

The paper feeding device 10 is a device capable of separating one at a time the paper sheet positioned on an upper end (i.e., the uppermost end in a vertical direction in this embodiment) in a stack direction of a plurality of paper sheets held in the holding unit 11A of the paper supplying tray 11, as shown in FIG. 1, and transporting and supplying the paper sheet to the image forming unit 2 side. In this embodiment, the paper supplying tray 11 is detachably mounted on an apparatus body (i.e., body frame or housing) to which the image forming unit 2 or the like are assembled.

Figure 2:
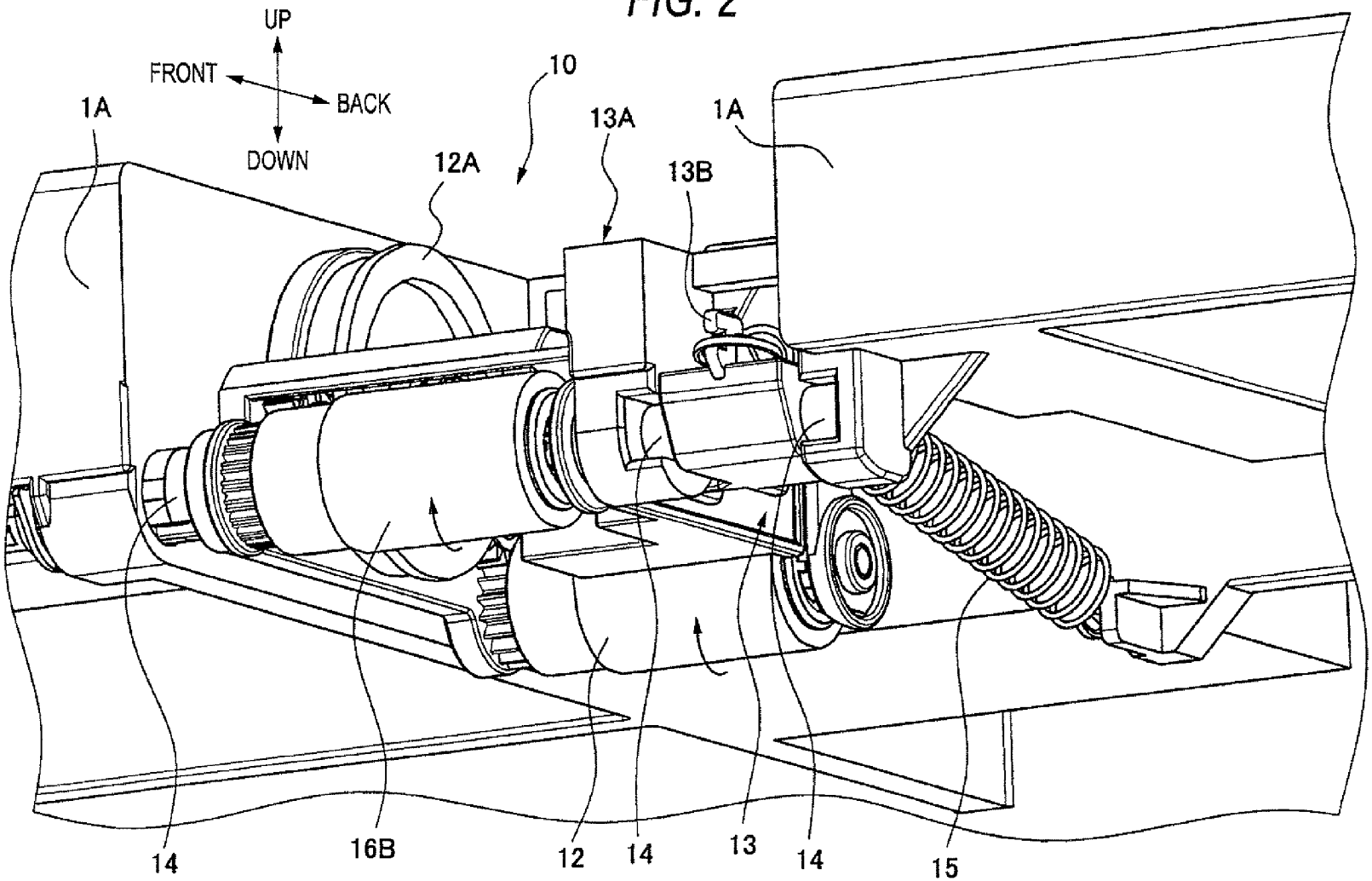
FIG. 2 is an enlarged perspective view of a paper feeding device according to an embodiment of the invention.

The pickup roller 12 is configured to feed the paper sheet by rotating in a state in which the pickup roller 12 comes in contact with the paper sheet positioned on the uppermost end held in the holding unit 11A. The pickup roller 12 is assembled to a holder body 13A in a rotatable manner, as shown in FIG. 2.

Figure 3:
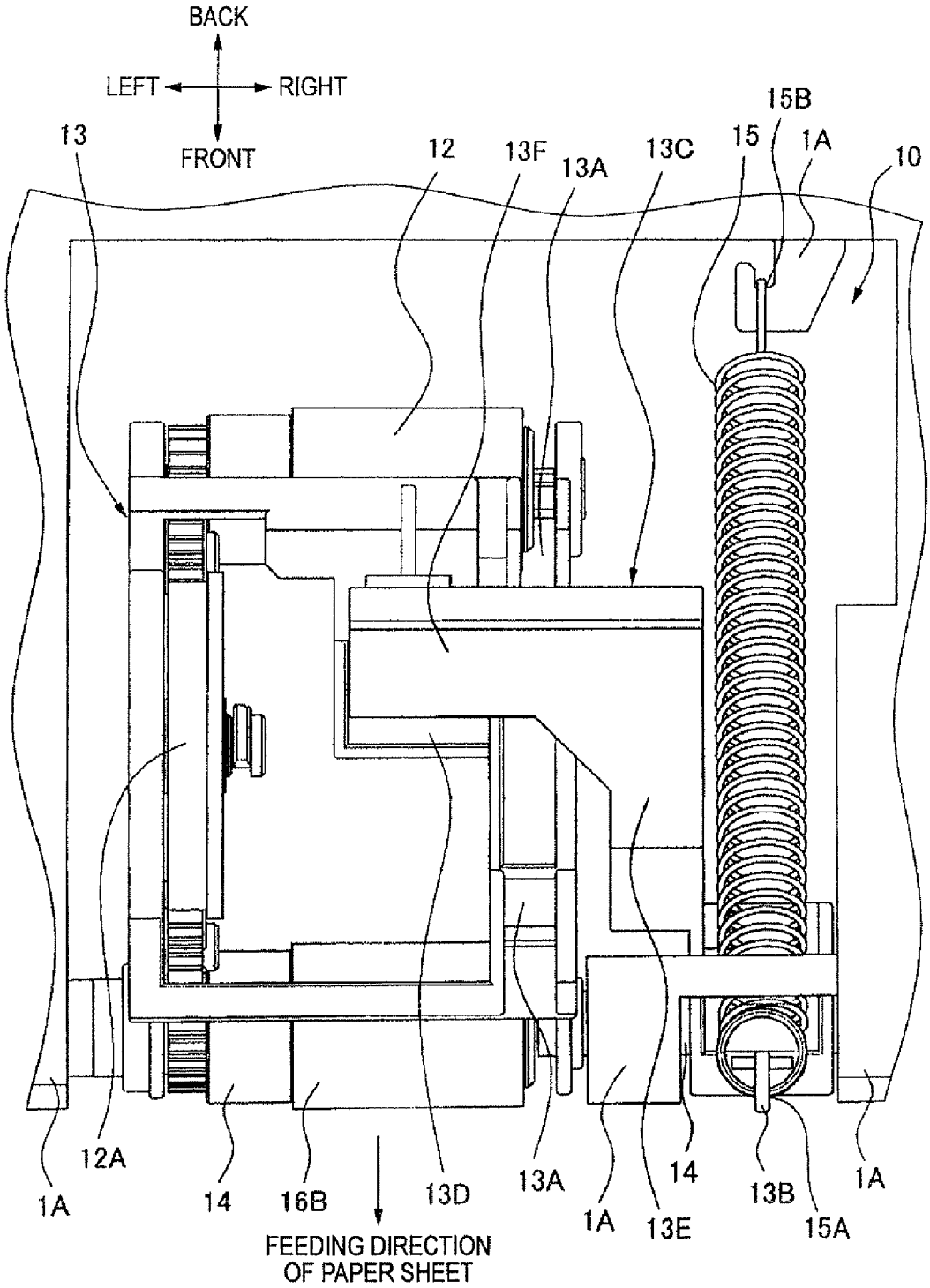
FIG. 3 is a plan view of a paper feeding device according to an embodiment of the invention.

The holder body 13A is formed as a rectangular frame of resin, which extends substantially parallel with a feeding direction of the paper sheet when seen from an upper surface side, as shown in FIG. 3. One end side (a downstream side of the feeding direction in this embodiment) of the holder body 13A in the extending direction is swingably attached to the body frame 1A through a swing shaft 14, as shown in FIG. 2.

Figure 4:
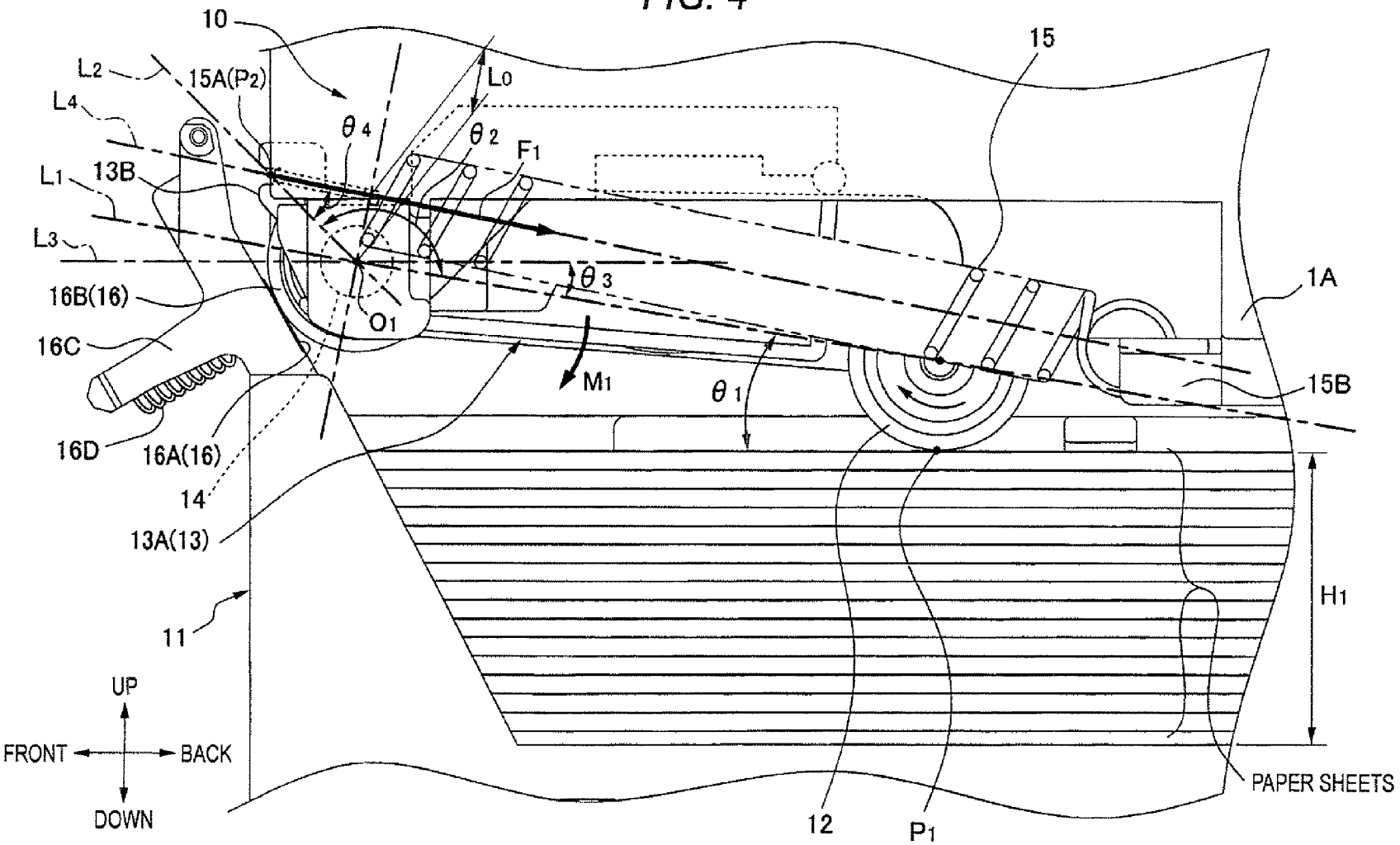
FIG. 4 is a view of a paper feeding device, which is viewed at a horizontal direction, according to an embodiment of the invention, when a holding unit holds a full stack of sheets.

The swing shaft 14 is installed at a position closer to the pickup roller 12 than the holding unit 11A (i.e., the upward side of the paper supplying tray 11 in this embodiment), as shown in FIG. 4. Meanwhile, the pickup roller 12 is attached to a distal end side of the holder body 13A, which extends from the swing shaft 14 toward the holding unit 11A side.

Further, a spring 15 is a resiliently-deformable unit, which is configured to generate a moment (hereinafter, this moment is referred to as a swing moment M1) to swing the holder body 13A in a direction which increases the contact surface pressure between the paper sheet held in the holding unit 11A and the pickup roller 12.

The spring 15 is a coil-type tension spring, of which one axial end is connected to a distal end side of a hook arm 13B, which extends in a diameter direction of the swing shaft 14 from a swing center O1 of the holder body 13A, and the other axial end is fixed to the body frame 1A.

As shown in FIG. 2, the hook arm 13B is attached to the swing shaft 14, in a swingable manner, at a position which deviates from the holder body 13A in an axial direction of the swing shaft 14. As shown in FIG. 3, the hook arm 13B is integrally formed with a pressing lever 13C which extends from the swing shaft 14 towards the pickup roller 12 side and comes in contact with the holder body 13A, as shown in FIG. 3.

The pressing lever 13C is formed of a substantially L shape, and comprises an arm portion 13E extending from the swing shaft 14 toward the pickup roller 12 side, and a pressing portion 13F extending in parallel with the axial direction of the pickup roller 12 from the distal end of the arm portion 13E. The pressing portion 13F comes in contact with a portion of the holder body 13A closer to the pickup roller 12 side. Meanwhile, the holder body 13A is provided with a pressure receiving portion 13D, which comes in contact with the pressing portion 13F to receive a swing moment M1 from the pressing lever 13C.

For this reason, in this embodiment, the swing moment M1 of the spring 15 acts on the holder body 13A via the pressing lever 13C, and the holder body 13A receives the swing moment M1 via the pressure receiving portion 13D, so that the paper sheet is pressed by the pickup roller 12. In this embodiment, the holder body 13A, the hook arm 13B, and the pressing lever 13C constitute a holder arm 13.

In this instance, the expression 'a portion of the holder body 13A closer to the pickup roller 12 side' means a portion of the holder body 13A closer to the pickup roller 12 side than an intermediate (center) portion from the swing shaft 14 to the pickup roller 12.

As shown in FIG. 4, a connection portion 15A of the spring 15 and the hook arm 13B, and a stationary end 15B of the spring 15 and the body frame 1A are all set at a side of a contact portion P1 opposite to the holding unit 11A of the paper supplying tray 11. In the contact portion P1, the pickup roller 12 contacts the uppermost sheet held in the holding portion 11A, That is, the connection portion 15A and the stationary end 15B of the spring 15 are set above the holding unit 11A.

Further, a separation mechanism 16 is provided at a downstream side of the pickup roller 12 in the feeding direction of the paper sheet. The separation mechanism 16 separates plural paper sheets fed by the pickup roller 12 and supplies the paper sheet to the pair of registration rollers 7. The separation mechanism 16 includes a separation pad 16A which comes in contact with the paper sheet fed by the pickup roller 12 to apply a predetermined transport resistance to the paper sheet, and a separation roller 16B, which rotates while pressing the paper sheet against the separation pad 16A.

The separation roller 16B receives a rotation force from the swing shaft 14 and is thus rotated in a state in which the separation roller 16B is supported by the swing shaft 14. Meanwhile, the separation pad 16A is attached to a wall portion of the paper supplying tray 11 in a swingable manner via the pad holder 16C, as shown in FIG. 4.

In this instance, the pad holder 16C is pressed against the separation roller 16B by a spring 16D, and the contact surface pressure between the separation pad 16A and the paper sheet is automatically adjusted by the spring 16D so as to set the pressure in a predetermined range.

In this structure, the separation roller 16B is integrally formed with the swing shaft 14, so that the separation roller 16B directly receives rotation force from the swing shaft 14. However, the pickup roller 12 is rotated by a rotation force received from the swing shaft 14 via an intermediate roller 12A, which is rotatably attached to the holder body 13A, as shown in FIG. 3.

3. Operation of the Paper Feeding Device

Figure 5:
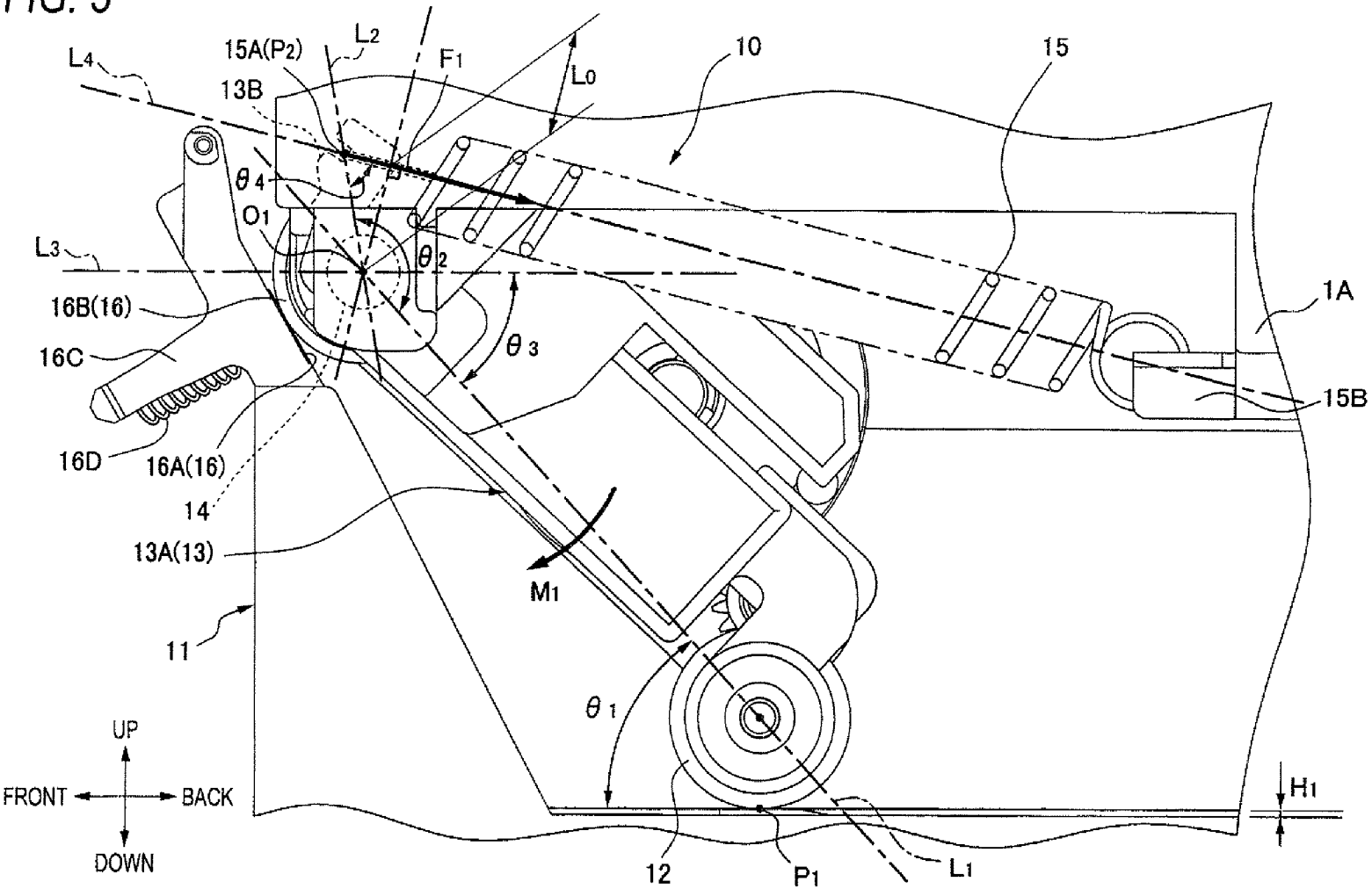
FIG. 5 is a view of a paper feeding device, which is viewed at a horizontal direction, according to an embodiment of the invention, when a holding unit is empty.
Figure 6:
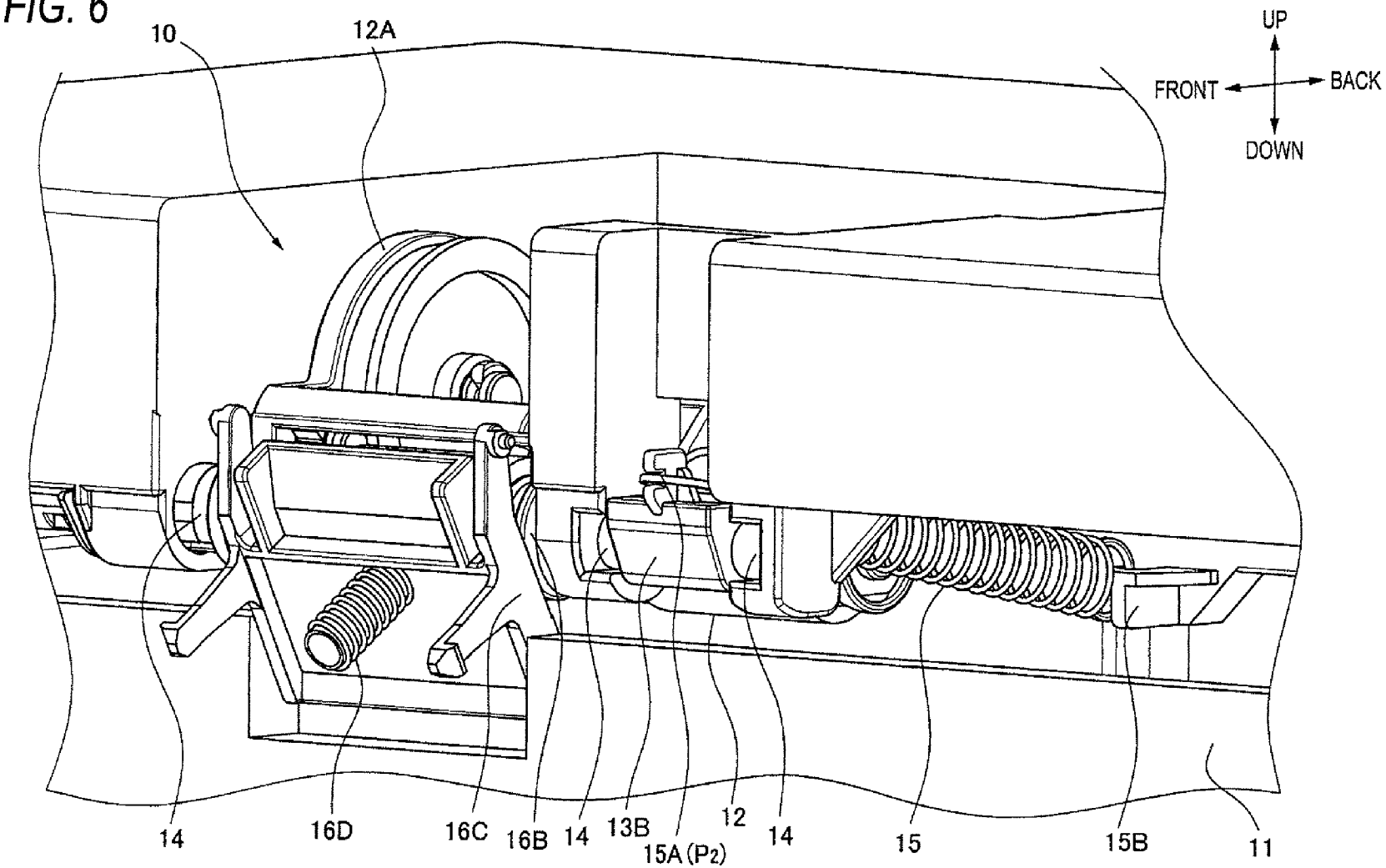
FIG. 6 is an enlarged perspective view of a paper feeding device including a paper supplying tray according to an embodiment of the invention.

As described above, the swing moment M1 always acts on the holder arm 13, so that the pickup roller 12 is always pressed toward the paper sheet (i.e., a bottom portion of the holding unit 11A). As shown in FIGS. 4 and 5, the holder arm 13 swings so that the pickup roller 12 continuously comes in contact with the paper sheet positioned on the uppermost end of the stack, irrespective of the number of paper sheets (a height H1 of the stack direction) held in the holding unit 11A.

In this embodiment, an angle θ2 of the hook arm 13B, a position of the stationary end 15B of the spring 15, and the like are set in order to increase the swing moment M1 as a contact angle θ1 between an extending direction L1 of the holder arm 13 and the paper sheet held in the holding unit 11A increases.

The extending direction L1 of the holder arm 13 represents a direction of a straight line connecting the swing center O1 and a center of rotation of the pickup roller 12. The angle θ2 of the hook arm 13B represents an angle between the extending direction L1 extending from the holder arm 13 and a straight line L2 extending from the swing center O1 to an operating point P2, on which the resilient force of the spring 15 acts. In this connection, since the paper sheet is substantially horizontally held in the holding unit 11A, an angle θ3 between a horizontal straight line L3 passing through the swing center O1 and the extending direction L1 extending from the holder arm 13 is identical to the contact angle θ1.

That is, in this embodiment, the stationary end 15B of the spring 15 is set at a position closer to the pickup roller 12 side than the swing center O1. The angle θ2 of the hook arm 13B is a fixed value which is set as an angle larger than an angle of 90 degrees. In the case in which the number of the paper sheets held in the holding unit 11A is large (i.e., the holding unit 11A holds a full stack of paper sheets), as shown in FIG. 4, the contact angle θ1 decreases, and an angle between the extending direction L1 extending from the holder arm 13 and an axis L4 of the spring 15 decreases so as to be substantially in parallel with the extending direction L1. In this instance, the axis L4 of the spring 15 is an imaginary line passing the connection portion 15A (i.e., the operating point P2) and the stationary end 15B.

For this reason, as the contact angle θ1 increases, as shown in FIG. 5, a moment angle θ4 approaches 90 degrees, but as the contact angle θ1 decreases, as shown in FIG. 4, the moment angle θ4 decreases. Herein, the moment angle θ4 is defined as an angle between a direction of a resilient force F1 provided by the spring 15 and the straight line L2 extending from the swing center O1 to the operating point P2.

In this embodiment, the distance between the swing center O1 and the operating point P2 is constant, and as the contact angle θ1 increases, the moment angle θ4 increases. As a result, as the contact angle θ1 increases, the distance $L_O$ (a value obtained by multiplying sin θ4 and the distance between the swing center O1 and the operating point P2) between the swing center O1 and the axis L4 of the spring 15 extends.

Accordingly, in this embodiment, the swing moment M1 determined by the multiplication of the distance $L_O$ and the resilient force F1 increases as the contact angle θ1 increases.

In this instance, if the contact angle θ1 (the moment angle θ4) increases, since the connecting portion 15A (the operating point P2) approaches the stationary end 15B, the resilient force F1 decreases, and thus the swing moment M1 determined by the multiplication of the distance $L_O$ and the resilient force F1 may also decrease. Accordingly, in this embodiment, a resilient coefficient of the spring 15 is set to a low value to prevent the swing moment M1 from decreasing with the increase in the contact angle θ1.

In connection with this, when the paper supplying tray 11 is detached from the apparatus body, the pickup roller 12 may interfere with a lateral wall of a front surface side of the paper supplying tray 11. Accordingly in this embodiment, a retraction mechanism (not shown) retracts the pickup roller 12 and the holder arm 13 towards the apparatus body (i.e., the upper side of the paper supplying tray 11 in this embodiment) in cooperation with a detaching operation of the paper supplying tray 11.

4. Characteristic of the Image Forming Apparatus (in Particular, the Paper Feeding Device) According to this Embodiment In this embodiment, if the number of the paper sheets held in the holding unit 11A varies, the contact angle θ1 also varies. Since a normal force acting on the paper sheet by the pickup roller 12 is equal to (swing moment M1×cos θ1)/(a distance between the swing center O1 and the swing center of the pickup roller 12), if the contact angle θ1 increases while the swing moment M1 is constant, the normal force exerted on the paper sheet by the pickup roller 12, i.e. the contact surface pressure, starts to decrease.

Figure 7:
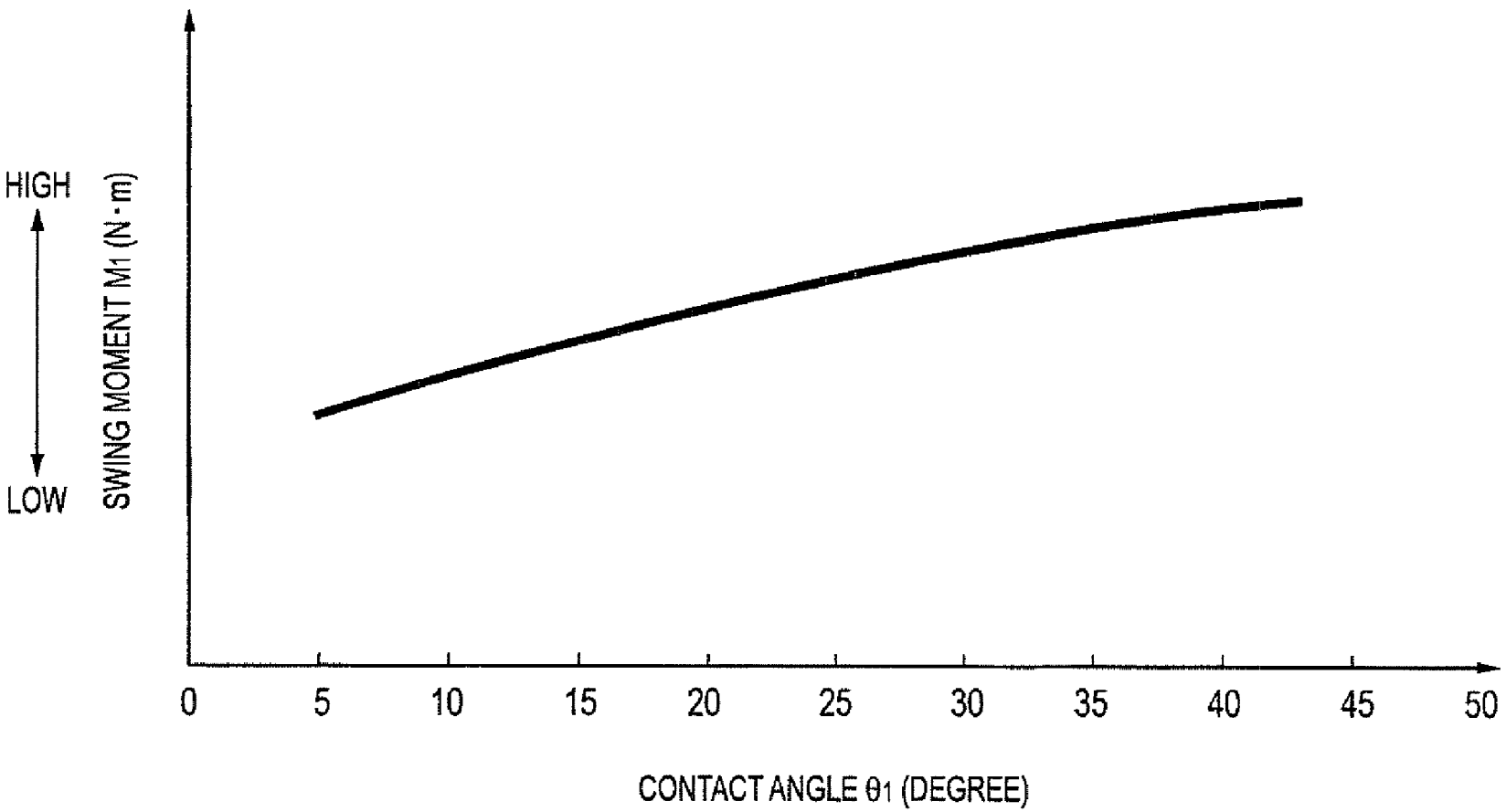
FIG. 7 is a graph illustrating a relationship between a swing moment and a contact angle.
Figure 8:
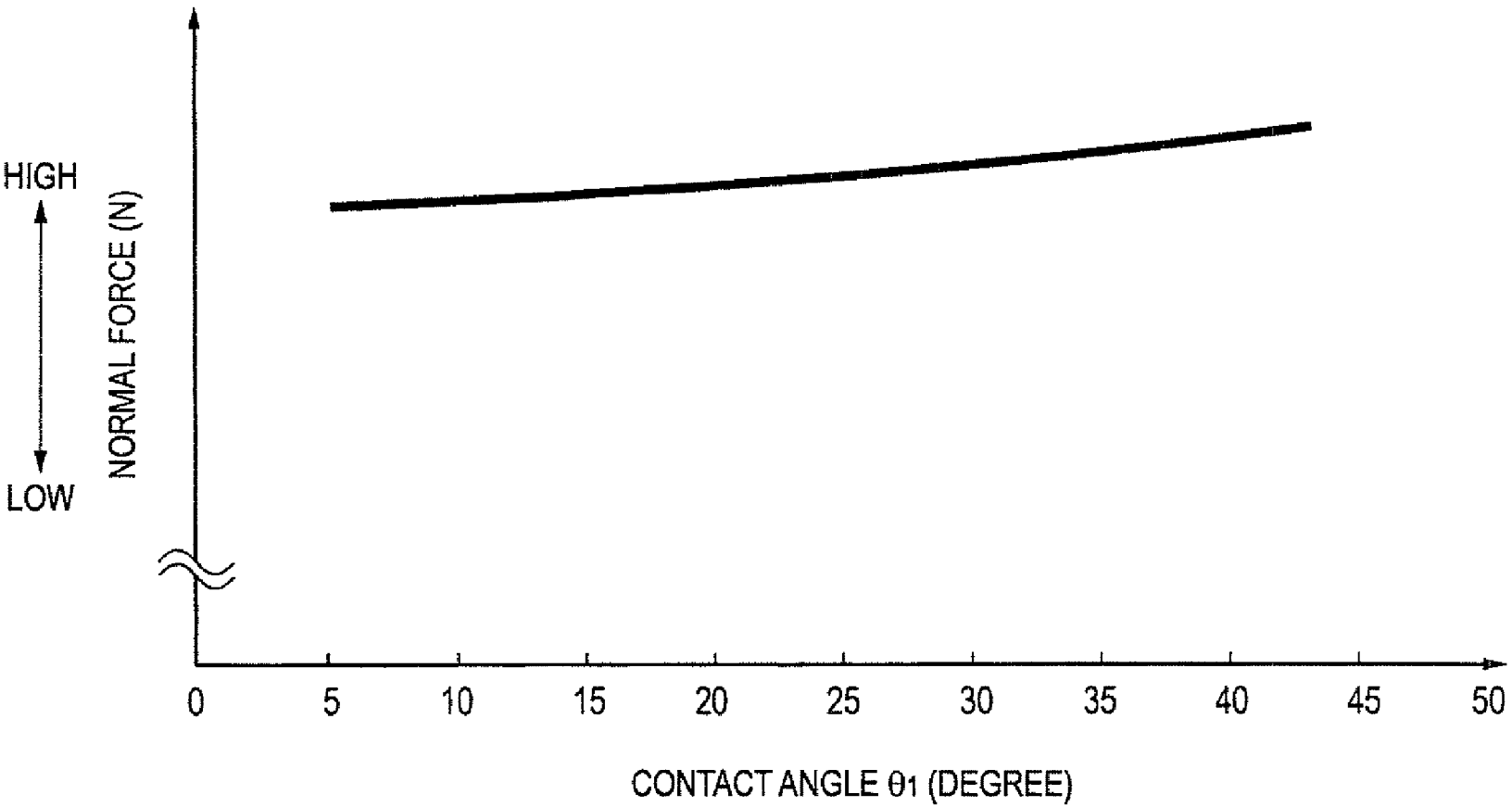
FIG. 8 is a graph illustrating a relationship between a normal force and the contact angle.

However, this embodiment is configured in such a way that as the contact angle θ1 increases, the swing moment M1 increases, as shown in FIG. 7. Therefore, as the contact angle θ1 increases, it is possible to suppress the normal force from being decreased, as shown in FIG. 8, and to thus suppress the contact surface pressure from being decreased.

Consequently, it is possible to reduce the manufacture cost of the paper feeding device 10 (the image forming apparatus 1) by eliminating a mechanism for upwardly displacing a paper pressing plate or the like. In addition, it is possible to transport the paper sheet reliably by suppressing the contact surface pressure between the paper sheet and the pickup roller 12 from remarkably varying.

In this embodiment, by setting the normal force as a reference value when the contact angle θ1 is minimized (i.e., the holding unit 11A holds a full stack of paper sheets), the angle θ2 of the hook arm 13B, the position of the stationary end 15B of the spring 15 and the like are set in such a way that a variance of the normal force is within a range of ±20% of the reference value.

If the connection portion 15A (the operating point P2) for connecting the spring 15 with the hook arm 1313 and the stationary end 15B of the spring 15 are set on the same side as the holding unit 11A, with respect to the contact portion P1 where the pickup roller 12 contacts the paper sheet, the spring 15 has to be installed at a position which deviates from the holding unit 11A in a direction parallel with the paper sheet (e.g., a vertical direction of a paper surface in FIG. 4). As a result, since a space for installing the spring 15 is newly required, the size of the paper feeding device may be increased.

In this embodiment, since the connection portion 15A and the stationary end 15B are installed at a side of the swing center O1 opposite to the holding unit 11A, that is, at the upper side of the holding unit 11A, the spring 15 can be installed by using the existing space, thereby preventing the paper feeding device from increasing in size.

Additionally, in this embodiment, since the holder arm 13 swings around the rotation center of the separation roller 16B as the swing center, for example, it is possible to decrease the size of the paper feeding device 10, compared with a case where the swing center O1 of the holder arm 13 is set at a portion other than the rotation center of the separation roller 16B.

Further, in this embodiment, since the swing moment M1 of the spring 15 acts on the holder body 13A via the pressing lever 13C, it is possible to reliably press the pickup roller 12 against the paper sheet, in a case where bending stiffness of the holder body 13A is not large.

That is, if the hook arm 13B is integrally formed with the holder body 13A, the swing moment M1 is transmitted to the pickup roller 12 via the holder body 13A. As a result, in the case where the bending stiffness of the holder body 13A is not large, the holder body 13A is deformed, so that the swing moment M1 may not be reliably transmitted to the pickup roller 12.

In this embodiment, since the swing moment M1 acts on the holder body 13A via the pressing lever 13C, the swing moment M1 can be transmitted to the pickup roller 12, without being greatly influenced by the bending stiffness of the holder body 13A. Therefore, it is possible to reliably press the pickup roller 12 against the paper sheet.

Further, in this embodiment, since the pressing lever 13C comes in contact with a portion of the holder body 13A closer to the pickup roller 12 side and the swing moment M1 acts on the holder body 13A, when the bending stiffness of the holder body 13A is not large, it is possible to suppress the holder body 13A from being largely deformed, thereby pressing reliably the pickup roller 12 against the paper sheet.

In addition, since the pressing lever 13C is provided with the pressing portion 13F extending in parallel with an axial direction of the pickup roller 12, it is possible to press the whole pickup roller 12 against the paper sheet uniformly and thus feed the paper sheet reliably.

In this embodiment, since the hook arm 13B is attached to a position which deviates from the holder body 13A in the axial direction of the swing shaft 14, the hook arm 13 does not interfere with the spring 15 and the holder body 13A, when the holder arm 13 swings.

Consequently, for example, when the spring 15 is placed in such a way that the spring 15 overlaps the holder body 13A when seen from a vertical direction (i.e., a stack direction of the paper sheet), a degree of flexibility in design increases, and thus a development term can be shortened.

5. Corresponding Relationship Between Subject Matters of the Invention and the Embodiment In this embodiment, the paper feeding device 10 corresponds to a sheet feeding device set forth in the claims, and the spring 15 corresponds to a resiliently deformable unit set forth in the claims.

Other Embodiments

In the above embodiment, the holder arm 13 comprises the holder body 13A, the hook arm 13B and the pressing lever 13C, and the swing moment M1 of the spring 15 is transmitted to the holder body 13A via the pressing lever 13C. However, the invention is not limited thereto, and the hook arm 13B may be integrally formed with the holder body 13A to transmit the swing moment M1 to the holder body 13A without passing through the pressing lever 13C.

Further, although the above embodiment relates to the sheet feeding device in which the paper sheet is loaded in a substantially horizontal direction and is stacked in a vertical direction, the invention is not limited thereto. For example, the stack direction of the paper sheet may be inclined with respect to the vertical direction.

In addition, although the spring 15 serving as the resiliently deformable unit is a coil-type torsion spring in the above embodiment, the invention is not limited thereto. For example, other resiliently deformable units such as a compression spring or a torsion coil spring may alternatively be employed.

Moreover, although the connection portion 15A (the operating point P2) is placed at a fixed position with respect to the hook arm 13B in the above embodiment, the invention is not limited thereto. For example, the swing moment M1 may be varied by providing a cam groove with the connection portion 15A to vary the position of the connection portion 15A, that is, the distance between the swing center O1 and the operating point P2, according to the variation of the contact angle θ1.

Further, although the swing center O1 of the holder arm 13 and the rotation center of the separation roller 16B are coincident with each other, the invention is not limited thereto.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. A sheet feeding device comprising:

a holding unit configured to hold a stack of sheets;

a pickup roller configured to contact a sheet placed on top of the stack held in the holding unit, the pickup roller being configured to rotate and feed the sheet from the stack;

a holder arm configured to swing around a swing center and hold the pick up roller at a position spaced apart from the swing center; and a resiliently-deformable unit, which generates a swing moment to swing the holder arm in a direction in which the pick up roller presses the sheet held in the holding unit, wherein the swing moment increases as a contact angle increases, wherein the contact angle is an angle between an extension direction of the holder arm and the sheet held in the holding unit.

2. The sheet feeding device according to claim 1, wherein a moment angle approaches 90 degrees as the contact angle increases, the moment angle is an angle between a direction of a resilient force produced by the resiliently-deformable unit and an imaginary line passing through the swing center of the holder arm and an operating point of the resilient force, and the moment angle decreases as the contact angle decreases.

3. The sheet feeding device according to claim 1, wherein the resiliently-deformable unit includes a coil-type tension spring, wherein a first axial end of the coil-type tension spring is connected to a portion of the holder arm which deviates from the swing center, and wherein a second axial end of the coil-type tension spring is stationary, and a connection portion between the resiliently-deformable unit and the holder arm is located at a position such that a distance from the swing center to an axis of the resiliently-deformable unit increases as the contact angle increases.

4. The sheet feeding device according to claim 3, wherein the connection portion is set at a side of a contact portion where the pickup roller contacts the sheet held in the holding unit opposite to the holding unit.

5. The sheet feeding device according to claim 3, wherein the second end of the resiliently-deformable unit is set at a side of a contact portion where the pickup roller contacts the sheet held in the holding unit opposite to the holding unit.

6. The sheet feeding device according to claim 1, further comprising a separation mechanism including a separation pad which comes in contact with the sheet fed by the pickup roller to apply a predetermined transport resistance to the sheet, and a separation roller, which rotates while pressing the sheet against the separation pad, wherein the holder arm swings around a rotation center of the separation roller as the swing center.

7. An image forming apparatus comprising:

the sheet feeding device according to claim 1; and an image forming unit that forms an image on a sheet fed from the sheet feeding device.

8. The sheet feeding device according to claim 1, wherein a moment angle approaches 90 degrees as the contact angle increases, and the moment angle is an angle between a direction of a resilient force produced by the resiliently-deformable unit and an imaginary line passing through the swing center of the holder arm and an operating point of the resilient force.

9. The sheet feeding device according to claim 1, wherein the resiliently-deformable unit includes a coil-type spring.

* * * * *